United States Patent [19]

Lecinski, Jr. et al.

[11] 4,227,616

[45] Oct. 14, 1980

[54] MOLDED GASKET PRESS-ON CLOSURE

[75] Inventors: Frank H. Lecinski, Jr., Harwood Heights; John N. Banich, Sr., Chicago, both of Ill.

[73] Assignee: The Continental Group, Inc., New York, N.Y.

[21] Appl. No.: 50,934

[22] Filed: Jun. 21, 1979

[51] Int. Cl.[3] ..... B65D 41/22

[52] U.S. Cl. ..... 215/246; 215/262; 215/346; 215/321

[58] Field of Search ..... 215/246, 262, 321, 345, 215/346

[56] References Cited

U.S. PATENT DOCUMENTS

| | | | |
|---|---|---|---|
| 2,437,515 | 3/1948 | Glocker | 215/345 X |
| 2,734,650 | 2/1956 | Meyer | 215/246 |
| 2,772,013 | 11/1956 | Stover | 215/346 X |
| 2,817,453 | 12/1957 | Stover | 215/346 X |
| 3,019,933 | 2/1962 | Gould | 215/321 |
| 3,071,275 | 1/1963 | Foss | 215/317 |
| 3,270,904 | 9/1966 | Foster | 215/345 X |
| 3,473,683 | 10/1969 | Zipper | 215/345 |
| 3,690,497 | 9/1972 | Lecinski | 215/318 |

*Primary Examiner*—Donald F. Norton
*Attorney, Agent, or Firm*—Charles E. Brown

[57] ABSTRACT

This disclosure relates to a closure for containers primarily of the tumbler and carafe types and wherein the containers are formed of glass or glass-like materials. The closure is particularly identifiable by a downward and radial extension of the normal sealing ring to define a lug structure which interlocks with the exterior finish of the container and serves to retain the closure in place, both initially and upon reclosing. If desired, a shrink band or tape may add to the initial holding of the closure in place. Advantageously only the gasket material of the sealing ring is engaged with the finish of the container. The closure is distortable by diametrically squeezing the skirt thereof so as to break the initial seal in the event the product is vacuum packed.

7 Claims, 8 Drawing Figures

MOLDED GASKET PRESS-ON CLOSURE

This invention relates in general to new and useful improvements in closures intended to be sealed on tumblers, carafes and other such containers having a smooth bead-type finish at the open end thereof.

At the present, closures formed of metal bodies and having metal lugs are typical for closing such containers, and the problem is that a utensil (opening device) is needed initially to remove the closure, and the use of such utensil generally distorts the closure, rendering it difficult or impossible to effect a complete resealing of the container.

A primary feature of this invention is to provide a closure wherein the gasket or sealing ring extends down within the skirt of the closure body and has an interlock with the exterior finish of the container. Most particularly, the extent of the interlock may be readily varied so that the force required for the removal of the closure from a container may be varied so that the force may vary between that which can be exerted with one's thumb and that requiring a utensil-type opening device.

A particular feature of the invention is that no closure distortion takes place with the closure in question even when a utensil-type opener is utilized, and thus the closure can be utilized to effect a liquid-tight resealing when so desired.

Another feature of the invention is that the closure is operable on currently existing glass finishes that have a projecting bead or a recess for receiving a projecting lug(s) formed from the gasket material.

In accordance with this invention, a shrink band may be advantageously utilized to cover the closure and container neck, thereby eliminating the accidental removal of the closure when the closed containers are being packed. Such a shrink band is particularly usable in conjunction with closures which may be removed with thumb pressure only.

A further feature of the invention is that the body of the closure has a depending skirt of sufficient axial extent whereby it may be squeezed at diametrically opposite points to cause an upward bowing of the end panel and sealing ring to effect a separation of the sealing ring from the sealing surface of the container, and thereby relieve a vacuum within the container and its holding force on the closure.

Most particularly, by utilizing the gasket material as the means for retaining the closure on the container, and by varying the extent of lugs formed from the sealing ring and the fit of such lugs with the peripheral finish of the container, the holding force of the closure on the container finish may be readily varied to meet the specific use requirement.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
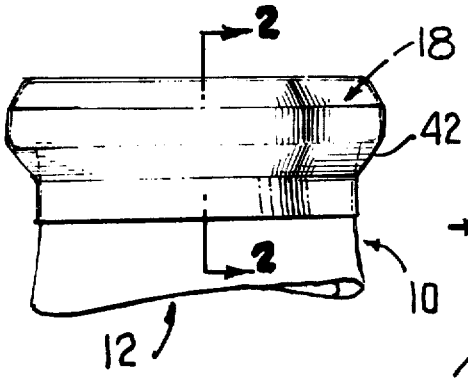
FIG. 1 is a fragmentary side elevational view of a container closed in accordance with this invention.
Figure 3:
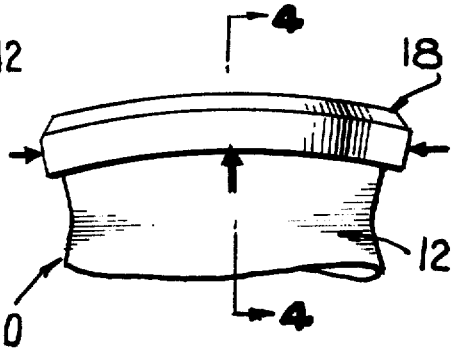
FIG. 3 is a schematic side elevational view showing the manner in which the closure may be readily deformed so as to break the seal between the sealing ring and the container sealing surface.

Referring now to the drawings in detail, it will be seen that there is illustrated in FIG. 1 a container assembly generally identified by the numeral 10. The container assembly 10 includes a container 12 which is preferably formed of glass or glass-like material and is illustrated as being in the form of a tumbler, but may be of a configuration of a carafe or like container. The container 12 has an open upper end which is primarily defined by an end finish defining a sealing surface 14. The exterior finish of the container adjacent the open end is of the recessed or cut-out type so as to define a retaining surface 16.

The container 12 may be of a conventional finish arrangement or may be modified so as to vary the configuration of the sealing surface 14 and the retaining surface 16 in accordance with the requirements of the packaged product.

Figure 2:
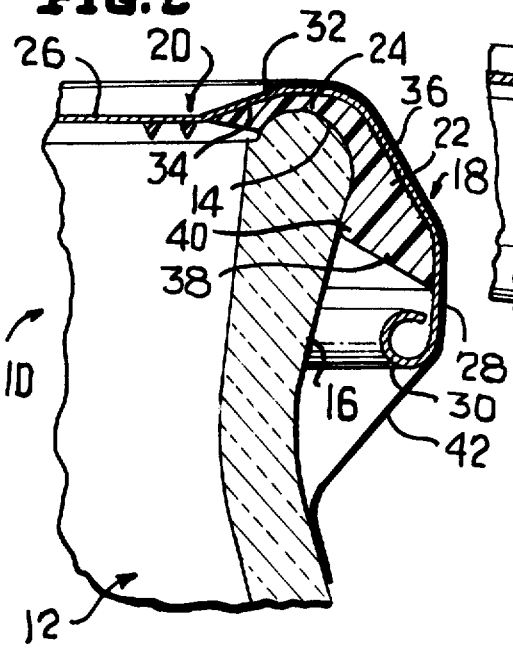
FIG. 2 is an enlarged fragmentary vertical sectional view taken generally along the line 2—2 of FIG. 1.

The container 12 is closed by a closure which is formed in accordance with this invention. The closure is generally identified by the numeral 18 and, as is best shown in FIG. 2, includes a cap-like container body 20 and a sealing ring 22 which is preferably formed of a suitable gasket material. The sealing ring 22 is configurated to define a sealing surface 24 which generally conforms to the sealing surface 14 and forms a seal therewith.

The body 20 includes an end panel 26 having a depending skirt 28 which terminates in the usual curl 30. The outer peripheral part of the end panel 26 is raised as at 32 so as to define a channel 34 into which the sealing ring 22 is molded. The channel 34 is in part defined by an upwardly and radially inwardly sloping upper portion 36 of the skirt 28.

It is to be noted that the sealing ring 22 extends down within the skirt 28 and thus includes a retaining portion 38. The retaining portion 38 includes a lug portion 40 which is engaged with the retaining surface 16 in interlocked relation so as to prevent the normal removal of the closure 18 from the container 12.

Depending upon the tightness of the interlock between the lug portion 40 and the retaining surface 16, the container assembly 10 may further include a shrink band or tape 42 which engages around and partially over the closure body 20 and engages the exterior finish of the container 12. The shrink band or tape 42 is particularly utilized when the holding pressure of the closure 18 is minimal so as to prevent the accidental displacement of the closure 18 relative to the container 12. For example, container assemblies, such as the container assembly 10, are packaged in cases with partitions, and if the partition should engage beneath the curl 30, the force of packing the container assemblies may result in the application of a sufficient force to dislodge the closure 18. The shrink band or tape 42 prevents this accidental dislodgement.

Figure 7:
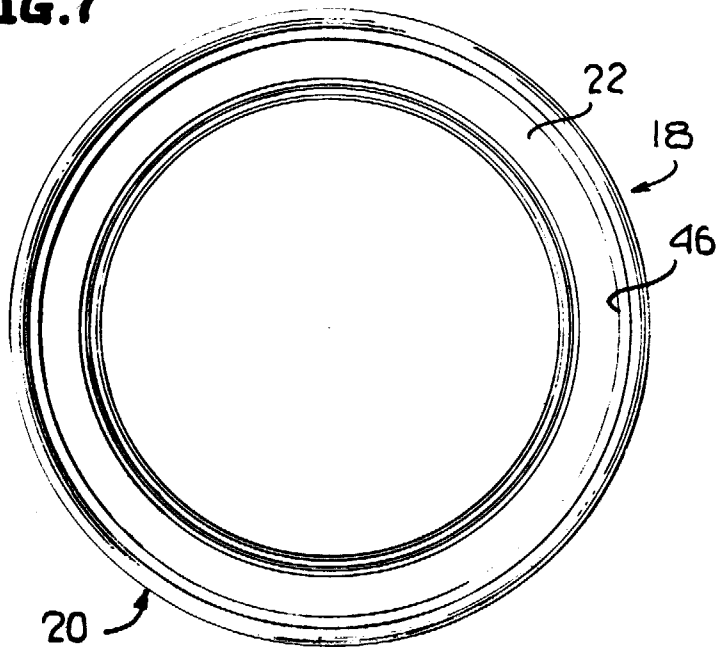
FIG. 7 is a bottom plan view of a modified form of closure having continuous lugs.
Figure 8:
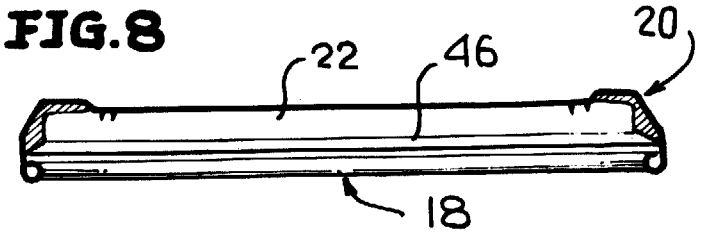
FIG. 8 is a transverse sectional view taken through the closure of FIG. 7, and shows the continuous lug.
Figure 5:
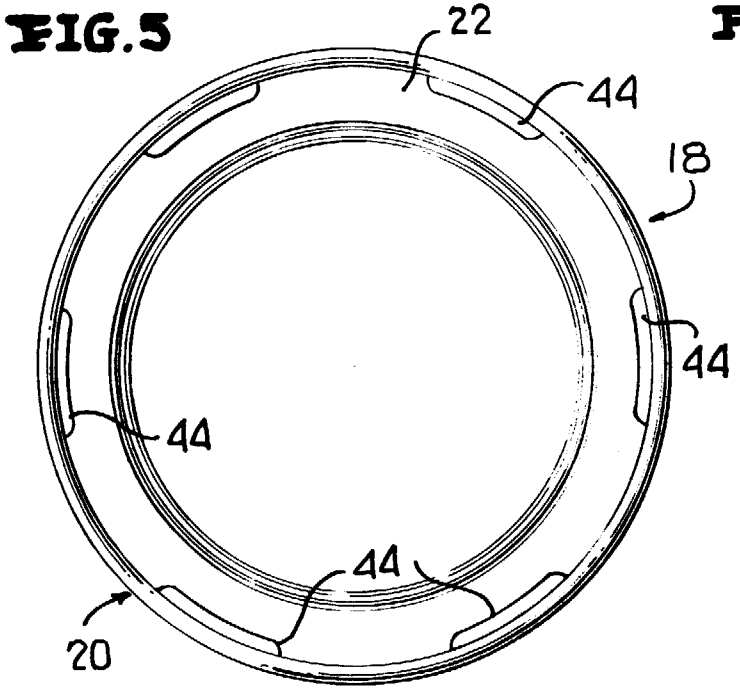
FIG. 5 is a bottom plan view of one form of closure.
Figure 6:
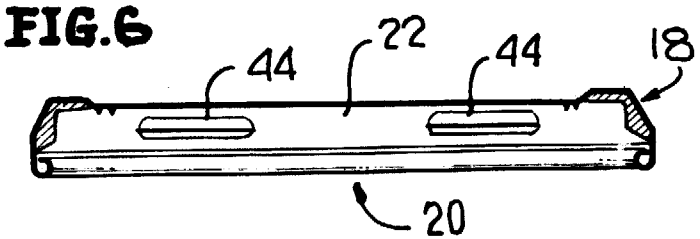
FIG. 6 is a transverse vertical sectional view of the closure of FIG. 5, and shows the lug arrangement thereof.

As is clearly shown in FIGS. 5–8, the lug portion 40 may, as in the case of the embodiment of FIGS. 5 and 6, be in the form of circumferentially spaced interrupted lugs 44, or, as in the case of the embodiment of FIG. 7, in the form of a continuous lug 46. It will be readily apparent that the holding force exerted by the lug portion 40, with all other conditions being the same, will be increased as the circumferential extent of the lug portion 40 increases. For example, if the lugs 44 occupy only 50% of the circumference of the possible maximum, the holding force will be proportionally decreased from that of the continuous lug 46. It is also to be understood that by controlling the radial extent of the lugs 44 or the continuous lug 46, the securing force may be varied.

It is intended that when the closure 18 has interrupted lugs, such as the lugs 44, the closure 18 may be readily removed by merely exerting a thumb pressure. On the other hand, when the lug is continuous, such as the continuous lug 46, an opening utensil will be required. In both arrangements there is limited distortion of the closure 18 during the opening operation. However, the body 20 has sufficient resiliency to return to its original configuration and thus the desired resealing may be readily effected.

Figure 4:
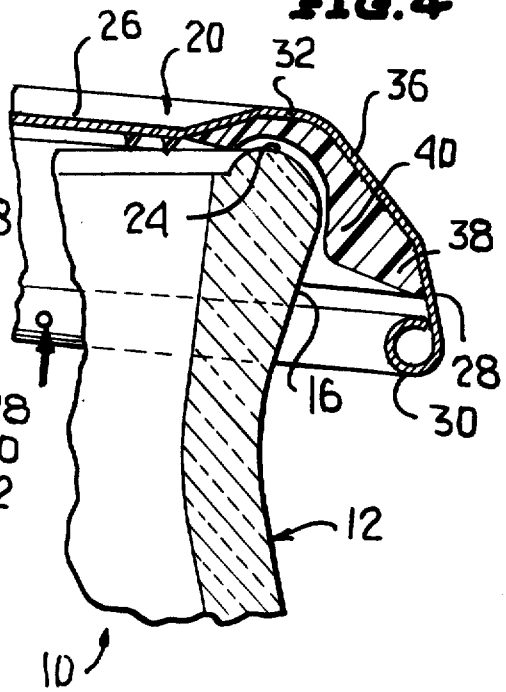
FIG. 4 is an enlarged fragmentary sectional view similar to FIG. 2 and taken along the line 4—4 of FIG. 3, and shows the release of the sealing ring from the container.

It is also pointed out here that the closure 18 may be beneficially utilized when the product is vacuum packed and the closure is at least in part, if not primarily, held in place by the force of the vacuum. As is shown in FIGS. 4 and 5, if one squeezes the skirt 28 at diametrically opposite points, the body 20 will bulge upwardly along the line normal to the line of force application and move the sealing ring 22 out of sealing contact with the sealing surface 14 so as to break the seal to relieve the vacuum. Once this initial breaking of the seal has been accomplished, the closure is held in place solely by the retaining force of the lug portion 40 and may be readily reclosed and again opened with a minimal force by merely pushing upwardly on the closure with one's thumb.

It will be readily apparent from the illustrated embodiments of the invention that all contact between the closure and the finish of the container is restricted to the gasket material forming the sealing ring 22. As a result, no chipping of the finish will result. Further, the arrangement permits the closure to be applied by an endwise force and requires no deformation of the closure body to effect final sealing or retention. Further, in order to effect the removal of the closure, deformation is primarily restricted to the sealing ring, although a certain amount of deformation of the closure body, particularly the skirt, is required. However, the required deformation of the metal closure body is restricted to one within the elastic limits of the closure body so that no permanent deformation of either the closure body or the sealing ring occurs during a normal opening operation, thus permitting effective resealing corresponding substantially to the original seal except in the case of vacuum packed products.

Although only several embodiments of the invention have been specifically illustrated and described herein, it is to be understood that minor variations may be made in the closure assemblies without departing from the spirit and scope of the invention as defined by the appended claims.

We claim:

1. A closure for tumbler-like containers, said closure comprising a cap-like body including an end panel having a depending skirt defining in conjunction with said end panel a corner, and a sealing ring seated in said corner, said closure being characterized in that said sealing ring extends axially along a portion of said skirt and includes radially inwardly directed lug means for interlocking engagement with a container external finish, said cap-like body being formed of a resilient flexible metal, said sealing ring being formed of a resilient gasket material, and said skirt extending axially beyond said sealing ring in a direction away from said end panel and in radially outwardly spaced relation relative to said lug means and forming means for facilitating distortion of said sealing ring to break a seal between said sealing ring and an intended container.

2. A closure in accordance with claim 1 wherein said lug means is in the form of a group of lugs arranged in circumferentially spaced relation.

3. A closure in accordance with claim 1 wherein said lug means is in the form of a group of lugs arranged in circumferentially spaced relation, said lugs being circumferentially elongated.

4. A closure in accordance with claim 1 together with a container having an open end defined in part by an endmost sealing surface, said sealing ring being seated on said sealing surface, said container having an undercut outer surface adjacent said open end, and said lug means being seated against said undercut outer surface.

5. A closure in accordance with claim 4 wherein the holding strength of said lug means is marginal for the product, together with a shrink band engaged partially over said closure and around a portion of said container adjacent said closure, and said shrink band forms holding means.

6. A closure in accordance with claim 4 wherein said container has a vacuum therein with said vacuum at least in part retaining said closure on said container.

7. A closure in accordance with claim 4 wherein said lug means is in the form of a group of lugs arranged in circumferentially spaced relation.

* * * * *